US006527435B2

(12) United States Patent
Thalheim

(10) Patent No.: US 6,527,435 B2
(45) Date of Patent: Mar. 4, 2003

(54) ASSEMBLING DEVICE

(75) Inventor: Jean-Francois Thalheim, Lignieres (CH)

(73) Assignee: Conseils et Manufactures VLG S.A., Neuchatel (CH)

( * ) Notice: Subject to any disclaimer, the term of this patent is extended or adjusted under 35 U.S.C. 154(b) by 9 days.

(21) Appl. No.: 09/931,924

(22) Filed: Aug. 20, 2001

(65) Prior Publication Data

US 2002/0027834 A1 Mar. 7, 2002

(30) Foreign Application Priority Data

Aug. 22, 2000 (EP) ..... 00117992

(51) Int. Cl.[7] ..... A44C 5/00; G04B 37/00
(52) U.S. Cl. ..... 368/281; 368/309
(58) Field of Search ..... 368/88, 281, 291, 368/294–296, 297–300, 309

(56) References Cited

U.S. PATENT DOCUMENTS 4,293,942 A 10/1981 Baumgartner
4,545,688 A * 10/1985 Ray et al. ..... 368/291
5,363,350 A * 11/1994 Marr-Andre et al. ..... 368/276

FOREIGN PATENT DOCUMENTS

CH 362985 8/1962
JP 59067485 4/1984
JP 01296187 11/1989
JP 09126368 5/1997

* cited by examiner

*Primary Examiner*—Vit Miska
(74) *Attorney, Agent, or Firm*—Young & Thompson

(57) ABSTRACT

A device for assembling two mechanical pieces, of which the first one (3) carries a skirt (14), which, in the assembled position, extends into a cavity of the second piece (1), by means of an elastic segment (5), is characterised by the fact that the elastic segment (5) is made of a material exhibiting a shape memory. This segment (5) can assume two different shapes, depending upon its temperature. This elastic segment (5) has an external peripheral part which is circular and which is engaged into a circular groove (4) provided on the second piece (1), this circular groove (4) being located in a plane which is perpendicular to the axis of the cavity of this second piece (1); this elastic segment (5) carries, on its inner periphery, protrusions (7) which, in a first state of the segment (5) are situated in the plane of the external peripheral part of the segment (5) and, in a second state of the segment (5), protrude out of this plane. The skirt (14) of the first piece has, on the one hand, a chamfered face (15) and, on the other hand, openings (16), which openings (16) co-operate with the protrusions (7) of the segment (5) after the assembling of the two pieces (2, 1).

7 Claims, 5 Drawing Sheets

ASSEMBLING DEVICE

The present invention is concerned with a device for assembling two pieces, which are to be coupled and uncoupled, without any special tools.

More particularly, this assembling device is designed for assembling two pieces, of which one includes a skirt extending, in the assembled position, inside the cavity of the other piece.

The present invention is concerned, more particularly, with a watch case, water-tight or not, wherein the assembling of the middle piece and of the bottom piece is achieved with an elastic segment.

Such water-tight watch cases are known from the document CH 362 985 which describes the assembling of the bottom piece with the middle piece of the case by means of a radially expandable segment including radial protrusions designed for co-operating with parts of the bottom piece. This segment is carried by the bottom piece and is designed for a partial engagement into a oblique groove of the middle piece. To close the case, one has to position the bottom angularly with respect to the middle piece, assemble the two pieces together and then operate a relative rotation thereof. In this manner, the radial protrusions of the elastic segment are displaced radially by said bottom piece to cause an expansion of the segment which extends into the oblique groove of the middle piece and to produce an axial tightening of the bottom piece against the middle piece.

This known water-tight watch case suffers major drawbacks. Firstly, the need to adjust the angular position of the bottom piece with respect to the middle piece, before they can be assembled together. Secondly, the need to carry out on the middle part complicated machining operations, in particular for forming the oblique groove. Finally, the need for the segment to be stressed in the water-tight closed position of the case, which causes a rapid wear of this segment.

The aim of the present invention is to provide a watch case wherein the assembling of the bottom piece with the middle piece is ensured by an elastic segment, but which obviates the above-mentioned drawbacks, i. e. wherein the positioning of the bottom piece into the middle piece can be carried out in any relative angular position of these two pieces, wherein the machining operations are simple to carry out and wherein the elastic segment is in an unstressed rest position when the case is in its closed position.

The object of the present invention is an assembling device, in particular for a watch case, which includes a middle piece and a bottom piece assembled through an elastic segment and which is characterised by the features set out in claim 1 and in the dependent claims.

The appended drawing illustrates schematically and by way of example an embodiment of a watch casing according to the invention.

Figure 1:
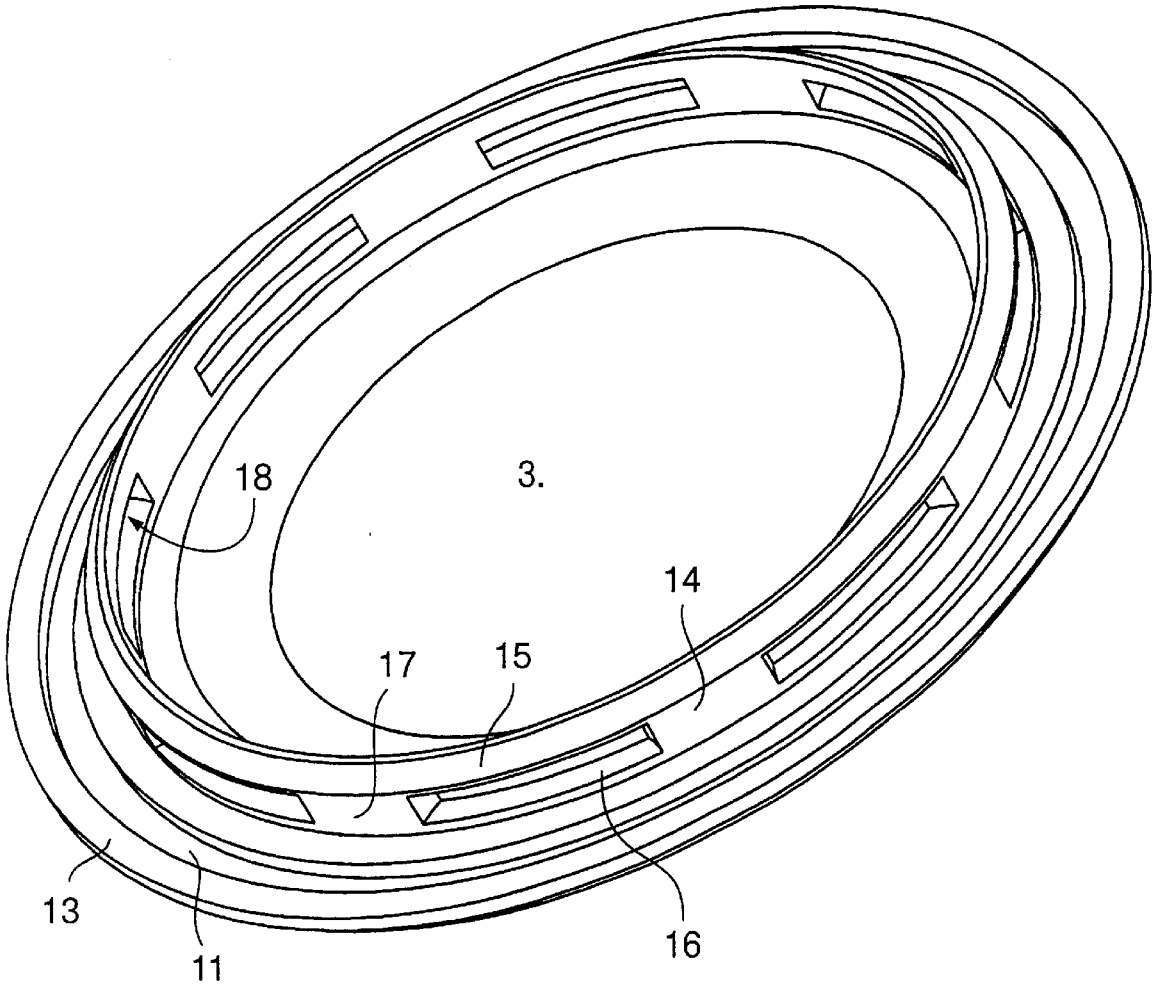
FIG. 1 is a perspective view of the bottom of the casing.
Figure 2:
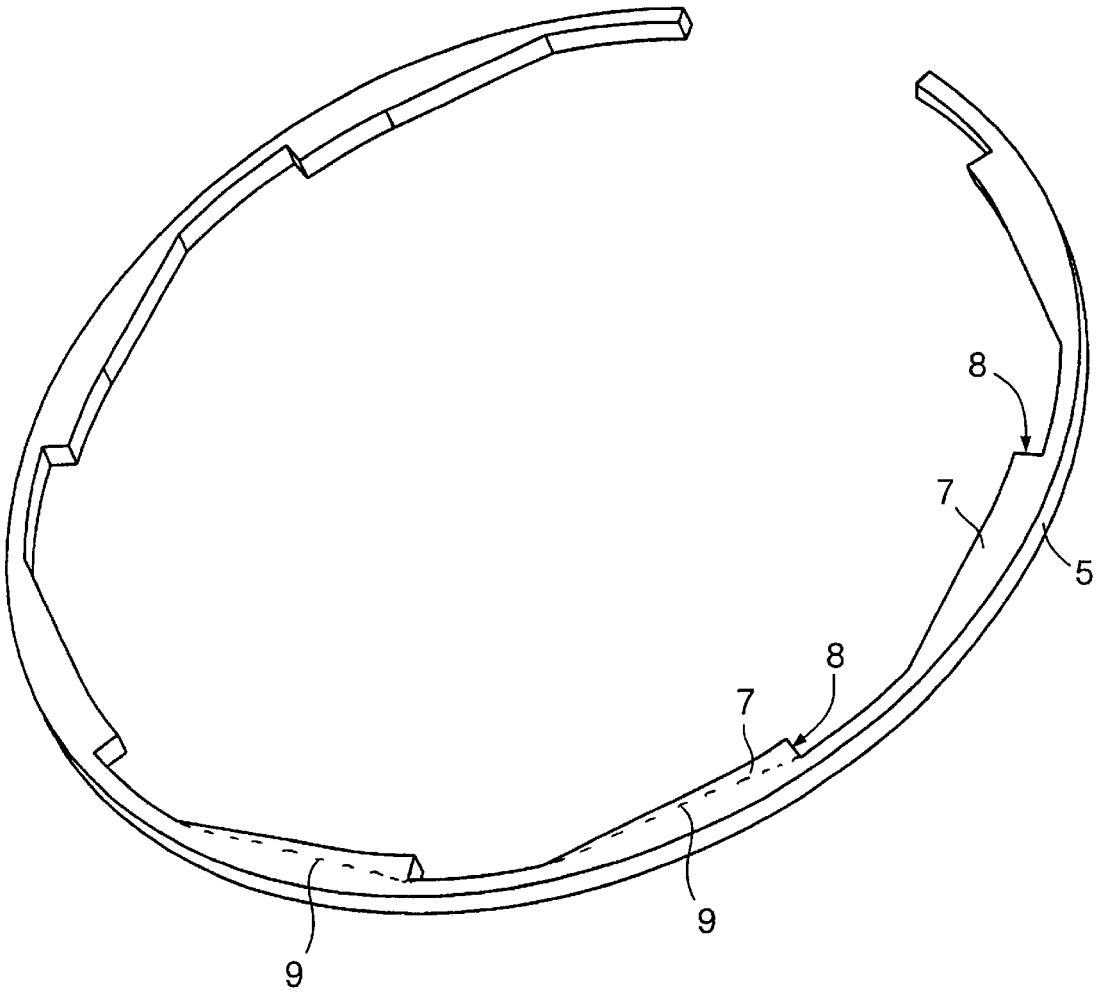
FIG. 2 is a perspective view of the elastic segment.

The watch case is comprise of a middle piece 1 with a bezel onto which is affixed on one side a glass 2 and on the other side a bottom piece 3. The glass 2 is affixed to the middle piece with a bezel in the usual manner, whereas the assembling of the bottom piece 3 to the middle piece with a bezel is special.

This assembling of the bottom piece 3 onto the middle piece with a bezel is carried out as will be described in detail hereafter, by means of an elastic segment made of a material which has a shape memory.

The middle piece 1 with a bezel is provided with a circular groove 4 opening on the internal housing thereof designed for receiving a bottom piece 3. This circular groove 4 is arranged in a plane which is perpendicular to the axis of symmetry of the middle piece with a bezel and is, accordingly, easy to machine. This circular groove 4 is designed for receiving the peripheral part of an elastic segment 5 made of a material with a shape memory.

This elastic segment 5 has an outer periphery along a circle of a diameter which is lesser than that of the bottom of the groove 4 of the middle piece, but greater than the diameter of the hollow 6 onto which this groove 4 opens. Accordingly, in the unstressed position of the elastic segment 5, the same is partly housed in this circular groove 4. This segment is open in such a manner that it can expand elastically in the radial direction when subjected to the action of a radial pushing force.

The inner circumference of this segment 5 includes protrusions 7 having the general shape of sloping ramps and forming a succession of <<teeth >> or pawls 8. When the elastic segment 5 is positioned in the circular groove of the middle piece 1 with a bezel, the protrusions 7 of the segment 5 protrude into the housing 6 of the middle piece 1 with a bezel and, accordingly, out of the groove 4 thereof.

This elastic segment 5 exhibits the particular feature that at low temperature (i. e. in the order of −20° C. to −50° C.), it is in the same plane as the protrusions 7 extending from its periphery. However, at normal temperature (0° C. to 20° C. or more), the protrusions 7 become bent upwardly along lines 9 owing to the shape memory of the material of the segment 5 and these protrusions then deviate from the plane defined by the peripheral part of the segment 5.

The lower face of the middle piece 1 with a bezel exhibits a circular recess 10 with a flat bottom into which is housed the peripheral part 13 of the bottom piece 3. In this embodiment, this peripheral part of the bottom piece 3 includes a flat face provided with an annular groove 11 receiving an 0-ring 12, which, in the closed position of the case, is pressed against the lower face of the middle piece 1 with a bezel.

The bottom piece 3 further includes a cylindrical skirt 14 which extends in the closed position of the case, into the middle piece 1 with a bezel and which ends with a chamfered annular face 15. This skirt 14 is provided with openings 16, of which the number is equal to the number of protrusions 7 of the elastic segment 5 and which are designed for receiving these protrusions 7 to retain the bottom piece 3 in position when the case is closed.

To close the case, the middle piece 1 with a bezel and the elastic segment 5 are cooled with the result that the protrusions 7 become positioned in the plane of the peripheral part of the segment 5.

The skirt 14 of the bottom piece 3 is then engaged into the housing 6 of the middle piece with a bezel and the chamfered annular face 15 comes in contact with the protrusions 7. A pressure applied on the bottom piece 3 then causes a spreading apart of the ends of the segment 5 which can expand in the circular groove 4 of the middle piece with a bezel, and the chamfered face 14 then passes over the protrusions 7 which then position themselves in the openings 16 of the skirts, as a result of the elastic force exerted by the segment 5.

Figure 3:
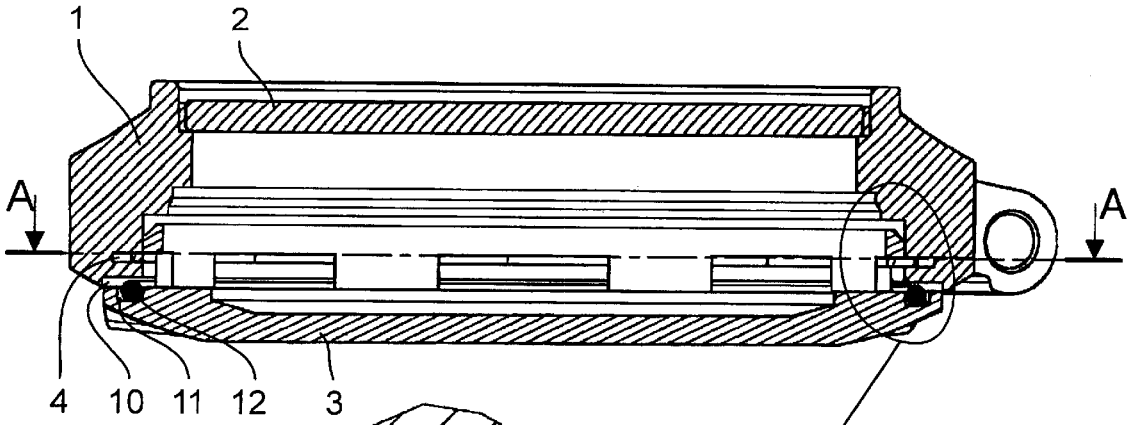
FIG. 3 illustrates in cross section the case when the bottom piece is introduced into the middle piece, but before the case is closed in a water-tight manner.
Figure 4:
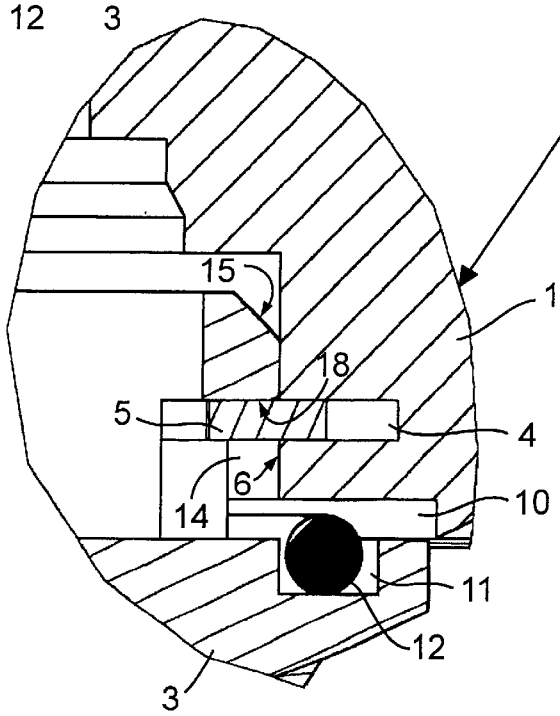
FIG. 4 shows a detail of FIG. 3, at an enlarged scale.
Figure 5:
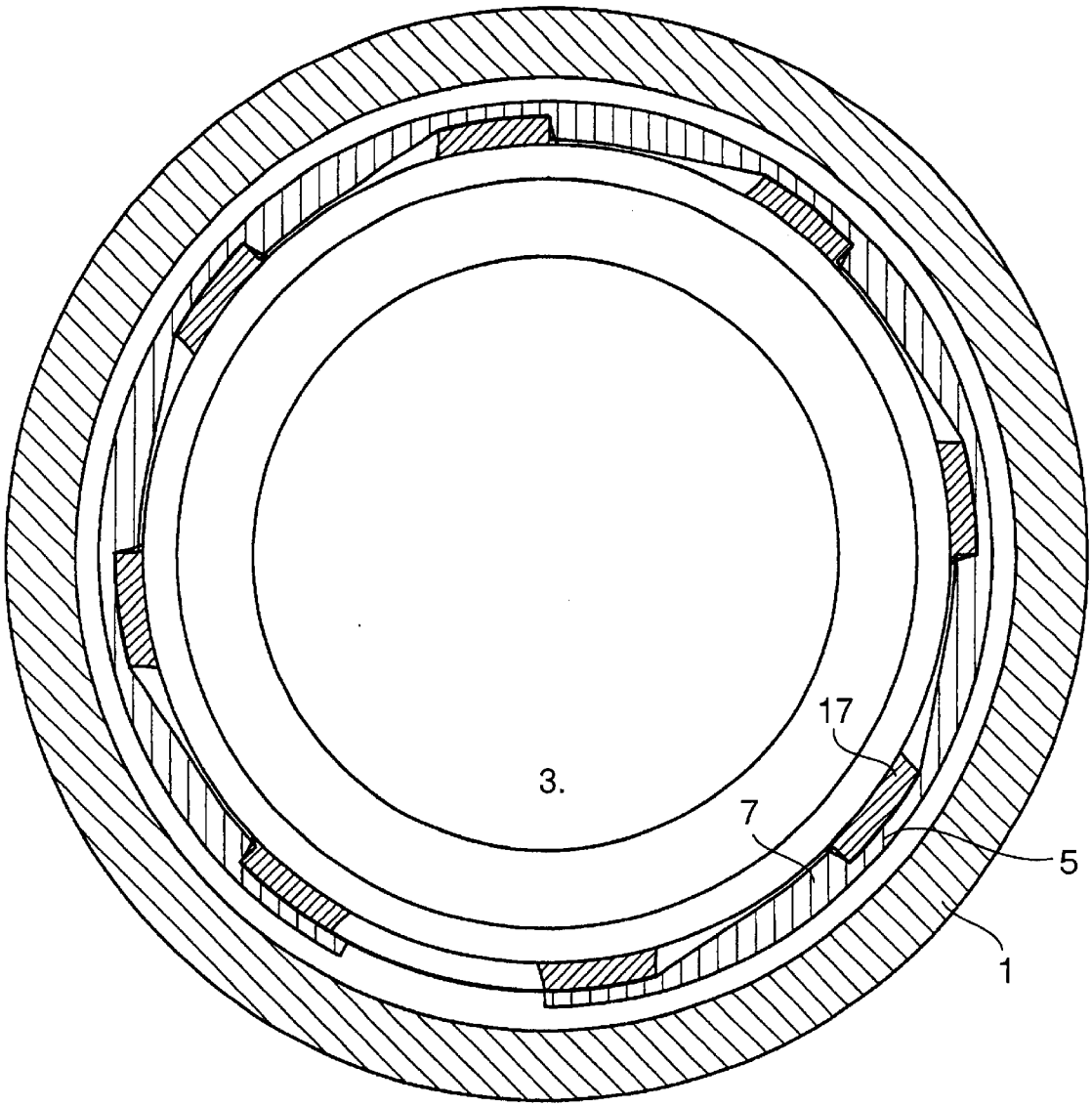
FIG. 5 is a cross-sectional view along line A—A of FIG. 3.
Figure 6:
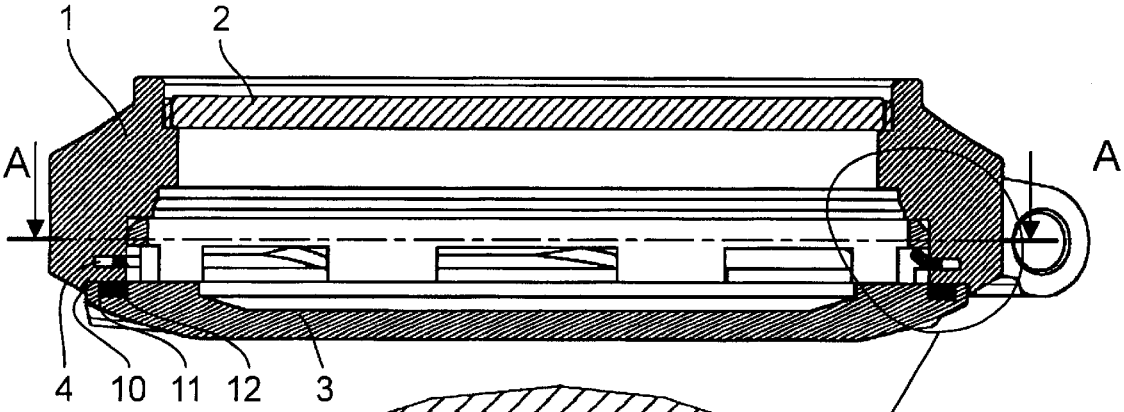
FIG. 6 is a cross-sectional view of the case in its closed water-tight position.
Figure 7:
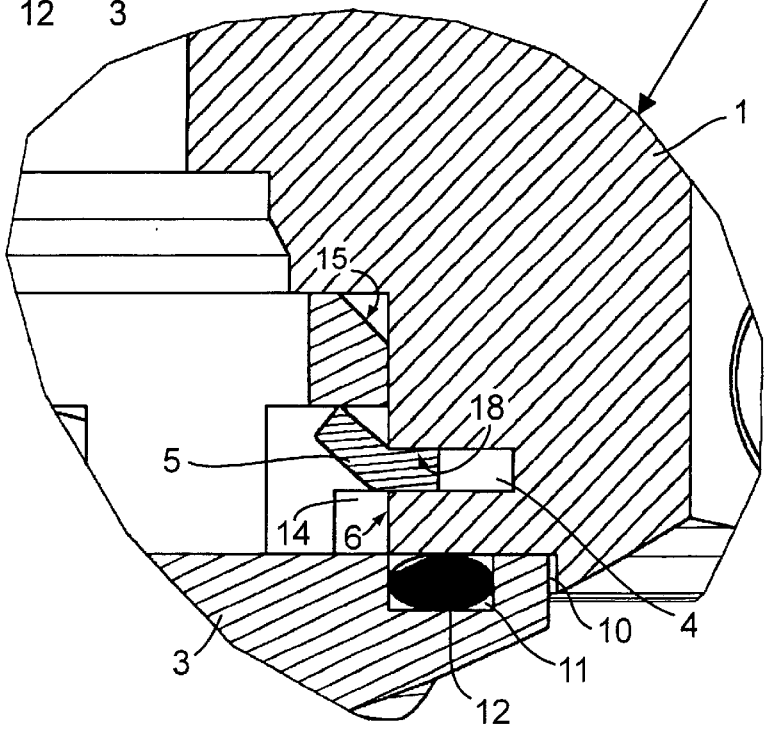
FIG. 7 shows a detail of FIG. 6, at an enlarged scale.

A slight rotation of the bottom piece 3 with respect to the middle piece 1 is operated, in such a manner than the pawls 8 of the protrusions abut against the columns between the openings 16 of the bottom piece. Finally, the casing is made to warm up to a temperature above 0° C., which, owing to the shape memory of the segment 5, causes a displacement of the protrusions 7 out of the plane of the peripheral part of the segment 5. These protrusions are thus applied against the upper face 18 of openings 16 of the skirts 14 of the bottom piece 3 and thus urge the bottom piece 3 in the closed position of the case against the middle piece 1 while compressing the O-ring 12. This displacement out of the transversal plane of the protrusions 7 causes the displacement of the bottom piece 3 from the position illustrated in FIG. 3 to that illustrated in FIG. 6.

The force pressing or tightening the bottom piece 3 against the middle piece 1 depends only upon constructional characteristics such as the dimensions of the bottom piece 3, of the middle piece 1 with a bezel and of the segment 5, as well as upon the elasticity characteristics of the protrusions 7 of this segment 5. This tightening force can be defined once and for all and does not depend upon manual operations such as the-tightening of screws, etc.

For opening the case, one only needs to cool the same to a temperature lesser than −20° C., which will cause the return of the protrusions 7 into the plane of the peripheral part of the segment 5. The bottom piece 3 is then rotated relative to the middle piece 1 with a bezel in such a manner that the columns 17 of the skirt 14 of the bottom piece act upon the sloping planes of the protrusions 7 to cause the elastic spreading apart of the ends of the segment 5 up to a point where the protrusions 7 are entirely disengaged from the openings 16, which then allows the axial extraction of the bottom piece 3 from the middle piece 1 with a bezel.

In alternate versions, one can obviously delete the O-ring 12, if it is not necessary that the case be water-tight. A stub can also be provided on the segment 5, in particular at one of its ends, which is designed to co-operate with a recess in the middle piece 1 with a bezel, in order to prevent an angular displacement of this segment with respect to the middle piece with a bezel.

The assembling of the bottom piece with the middle piece with a bezel described above offers clear advantages compared to prior systems.

The machining operations are simple and easily carried out, in particular that of the annular groove 4 of the middle piece 1 with a bezel, which groove is perpendicular to the axis of symmetry of this middle piece with a bezel.

The tightening force of the bottom piece against the middle piece with a bezel is completely determined by the characteristics of the pieces of the assembly and does not depend upon a tightening force applied to a screw or to some other fastening device.

The use of connector pieces, here the segment 5, which are unstressed, guarantees a proper functioning in the course of time. If a piece is put under stress, it will unavoidably experience fatigue. This fatigue is not acceptable in the case of a component such as a bottom piece. Furthermore, when a piece is stressed for blocking purposes, the friction between the two pieces in contact must be greater than the force produced by the stressed segment. If this requirement is not satisfied, the bottom piece will always tend to become disengaged.

The fact that the ends of the segment have to be spread apart in order to disengage the bottom piece provides additional safety against the risk of a spontaneous opening of the case.

The fact that the segment is mounted directly into the middle piece increases the robustness of the assembly. Since the segment is an element which is not thick, it is preferable to place it into the most rigid piece of the assembly.

The bottom piece and the middle piece with a bezel do not need to be placed beforehand into a predetermined angular position before the assembling or the disassembling of the case.

Quite obviously, this assembling device can be used elsewhere than for watch cases. In particular, it can be used for assembling two pieces of which one includes a skirt which, in the assembled position is located inside a cavity of the other piece.

What is claimed is:

1. A device for assembling two mechanical pieces of which the first one includes a skirt which, in the assembled position, extends within a cavity of the second piece, by means of an elastic segment, characterised in that the elastic segment is made of a material with a shape memory, this segment being capable of assuming two different shapes, depending on its temperature; in that this elastic segment has an external peripheral part which is circular and which is engaged into a circular groove provided on the second piece, this circular groove being situated in a plane which is perpendicular to the axis of the cavity of this second piece ; in that this elastic segment carries on its inner periphery protrusions, which, in a first state of the segment, are situated in the plane of the external peripheral part of the segment and, in a second state of the segment, protrude outside of this plane; and in that the skirt of the first piece has, on the one hand, a chamfered face and, on the other hand, openings, which openings co-operate with the protrusions of the segment after having assembled the two pieces.

2. A device according to claim 1, characterised in that, in the assembled position of the two pieces, the protrusions of the elastic segment are their second state and abut against a face of the openings of the first piece, thus urging an abutment face of this first piece against an abutment face of the second piece, with a predetermined force.

3. A device according to claim 2, characterised in that an O-ring is arranged in a circular groove provided in at least in one of said abutment faces.

4. A device according to claim 1, characterised in that the external diameter of the elastic segment, when unstressed, is lesser than the diameter of the bottom of the circular groove provided in the second piece.

5. A device according to claim 1, characterised in that the elastic segment is in its first state, entirely flat, when its temperature is lesser than −10° C. and, preferably, lesser than −20° C. and in that in its second state, the protrusions are displaced out of the plane of the segment by a temperature exceeding 0° C.

6. A device according to claim 1, characterised in that, in the assembled position, the elastic segment is in an unstressed rest position.

7. A device according to claim 1, characterised in that the first piece is the bottom piece of a watch casing and that the second piece is the middle piece with a bezel of a watch case.

* * * * *